US005385032A

United States Patent [19]

Martin et al.

[11] Patent Number: 5,385,032

[45] Date of Patent: Jan. 31, 1995

[54] REFRIGERATOR AIR FLOW CONTROL MECHANISM

[75] Inventors: Jerry C. Martin, Corydon, Ind.; Martin M. Zentner; Robert T. Mills, both of Louisville, Ky.

[73] Assignee: General Electric Company, Louisville, Ky.

[21] Appl. No.: 207,379

[22] Filed: Mar. 4, 1994

[51] Int. Cl.[6] ..... F25D 17/04

[52] U.S. Cl. ..... 62/187; 62/408; 62/441; 312/407.1

[58] Field of Search ..... 62/407, 408, 440, 441, 62/447, 454, 177, 186, 187; 312/407, 407.1

[56] References Cited

U.S. PATENT DOCUMENTS 4,914,928 4/1990 Fellwock et al. ..... 62/408

5,097,675 3/1992 Elsom et al. ..... 62/408

*Primary Examiner*—John M. Sollecito

*Attorney, Agent, or Firm*—H. Neil Houser

[57] ABSTRACT

A mechanism to control air flow between the freezer and fresh food compartments of a refrigerator includes an elongated air flow tube and a flow control housing with mating planar surfaces angled relative to the longitudinal axis of the air flow tube. A mating gasket is positioned between the planar surfaces and joined to each with adhesive. An electrical conductor extends through the air flow passageway in the tube and housing and includes a plug of material around the conductor's protective cover. A recess in the housing mounts the plug with an angled surface of the plug filling a matching interruption in the housing's planar surface to prevent air leaks around the conductor. The housing and plug include cooperating dimples which receive a capillary tube extending through the air passage.

13 Claims, 3 Drawing Sheets

REFRIGERATOR AIR FLOW CONTROL MECHANISM

BACKGROUND OF THE INVENTION

The present invention relates to refrigerators and, more particularly, to an improved mechanism for controlling the air flow between the freezer and fresh food compartments of a refrigerator.

Many modern refrigerators have separate freezer and fresh food compartments, separated by an insulated dividing wall or mullion. Typically the evaporator is located in the freezer and the temperature in the fresh food compartment is controlled by controlling the flow of cold air from the freezer to the fresh food compartment. Often the freezer thermostat and its adjustment mechanism are placed in the fresh food compartment for the convenience of the user. This requires that the associated capillary tube extend through the mullion. Also, in many such refrigerators, a separate light is provided in the freezer and in more highly featured models various other electrically operated devices or accessories are located in the freezer. This results in an electric conductor extending between the freezer and the fresh food compartment. It would be advantageous to route the electric conductor and the capillary tube through the mechanism providing the controlled air flow between the compartments, so as to minimize the number of elements extending through the insulated mullion.

In addition, many of the air flow control mechanisms in use today include complicated air seals with gaskets that are required to seal between two surfaces that lie in more than one plane.

It is an object of this invention to provide a refrigerator with an air flow control mechanism that is simple and easy to construct and includes planar air sealing surfaces.

It is another object of this invention to provide such an improved air flow control mechanism that provides for the passage of an electric conductor and capillary tube between the compartments.

It is yet another object of this invention to provide such an improved air flow control mechanism in which the electric conductor and the capillary tube extend through the air flow passage.

It is still another object of this invention to provide such an improved air flow control mechanism, including means for controlling the flow of air between the compartments.

SUMMARY OF THE INVENTION

In accordance with one embodiment of this invention there is provided an improved mechanism for controlling the flow of cold air from the freezer compartment to the fresh food compartment of a refrigerator in which the compartments are separated by an insulated mullion with an air flow opening therethrough. An elongated air flow tube includes a peripheral wall defining a central air passage therethrough. One end of the wall is received in the mullion opening and the other end of the wall is positioned in the fresh food compartment. The fresh food compartment end of the wall is formed with a planar end surface angled with respect to the longitudinal axis of the tube. An air flow control includes a housing defining an air flow passage therethrough and has a planar flange surrounding one end of the passage. The flange has a shape and angle complimentary to the end surface of the tube wall. The tube and housing are connected with the tube end surface and the flange juxtaposed so the tube passage and housing passage form a continuous air flow passageway between the compartments. A planar gasket, with a complimentary shape is received between the end surface and the flange and joined to each with adhesive.

A baffle, mounted in the housing passage, has a position limiting air flow through the passage and is movable away from that position to permit greater air flow. A spring biases the baffle in one direction and a thermostat is connected to the baffle and acts in opposition to the spring so that the baffle's position is adjusted in response to variations in the air temperature in the fresh food compartment.

A flexible electric conductor extends between the compartments through the passageway. The housing includes a recess and the flange is interrupted in an area aligned with the recess. A rear wall of the housing spaced from the the flange includes a lip portion 80 extending around the recess. A plug, integral with the protective outer cover of the conductor, includes a peripheral recess which receives the lip portion of the wall. The plug also includes an inclined planar portion which fills the interruption in the flange. Thus the conductor will not cause deleterious leakage of air between the compartments.

A thermostatic capillary tube extends between the compartments through the passageway. The housing wall lip includes a dimple which closely receives the capillary tube and the plug includes a dimple which closely fits around the capillary tube so that the capillary tube will not cause deleterious leakage of air between the compartments.

DETAILED DESCRIPTION OF PREFERRED EMBODIMENT

Figure 1:
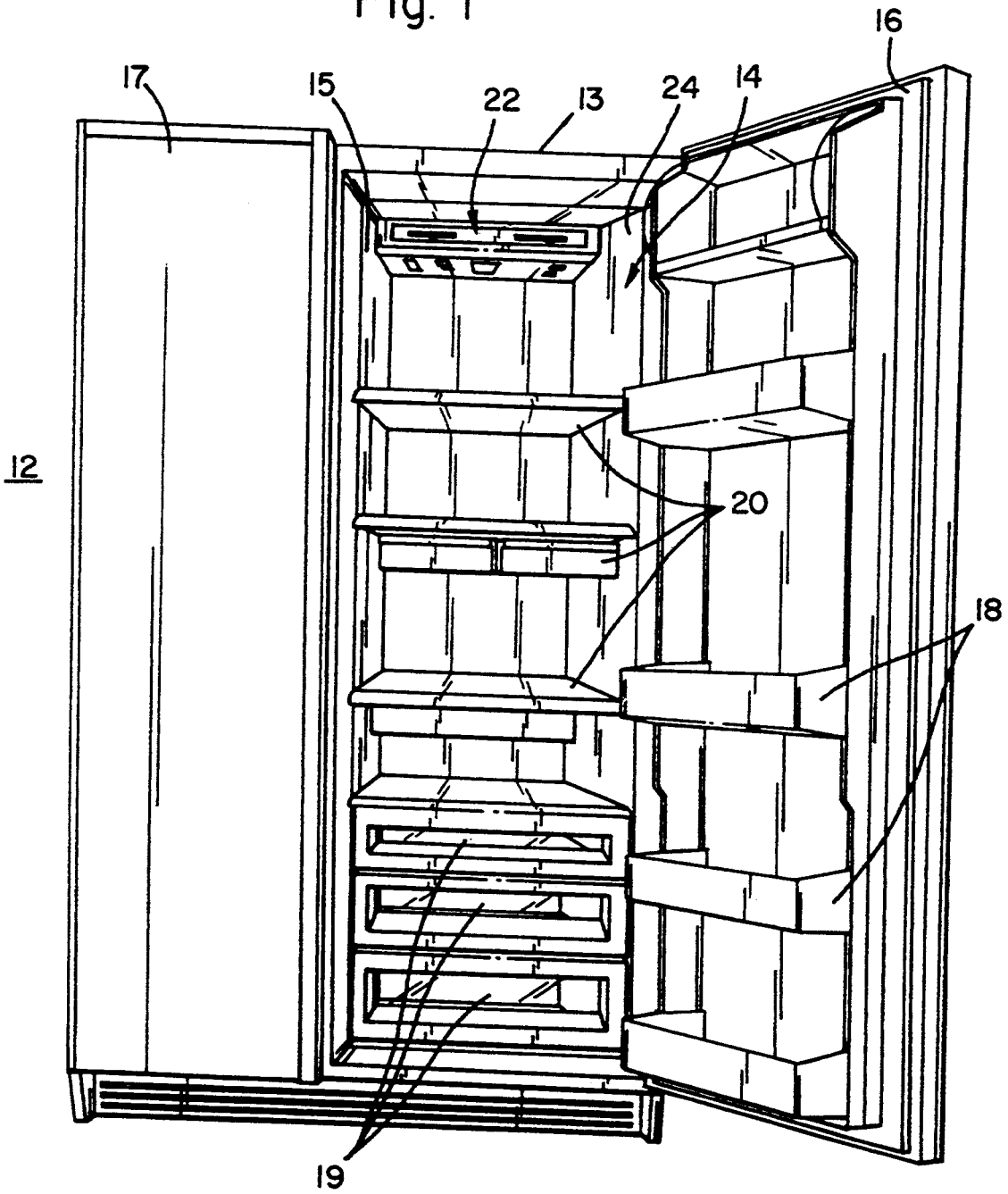
FIG. 1 is a simplified front perspective view of a side-by-side type of refrigerator, with the door to the fresh food compartment open for purposes of illustration.

Referring now to FIG. 1, there is illustrated a side-by-side refrigerator/freezer type of refrigerator 12 having an outer cabinet 13 containing a refrigerated fresh food compartment 14 and a freezer compartment, not shown, separated by an insulated internal wall or mullion 15. Access to the fresh food and freezer compartments is provided by a fresh food door 16 and a freezer door 17, respectively. Conveniently, the doors 16,17 are provided with a number of shelves, such as those illustrated at 18. Conveniently, the fresh food compartment is provided with a number of storage drawers 19 and shelves 20. It will be understood the freezer compartment also normally is provided with shelves and, in at least some models, with drawers.

Figure 2:
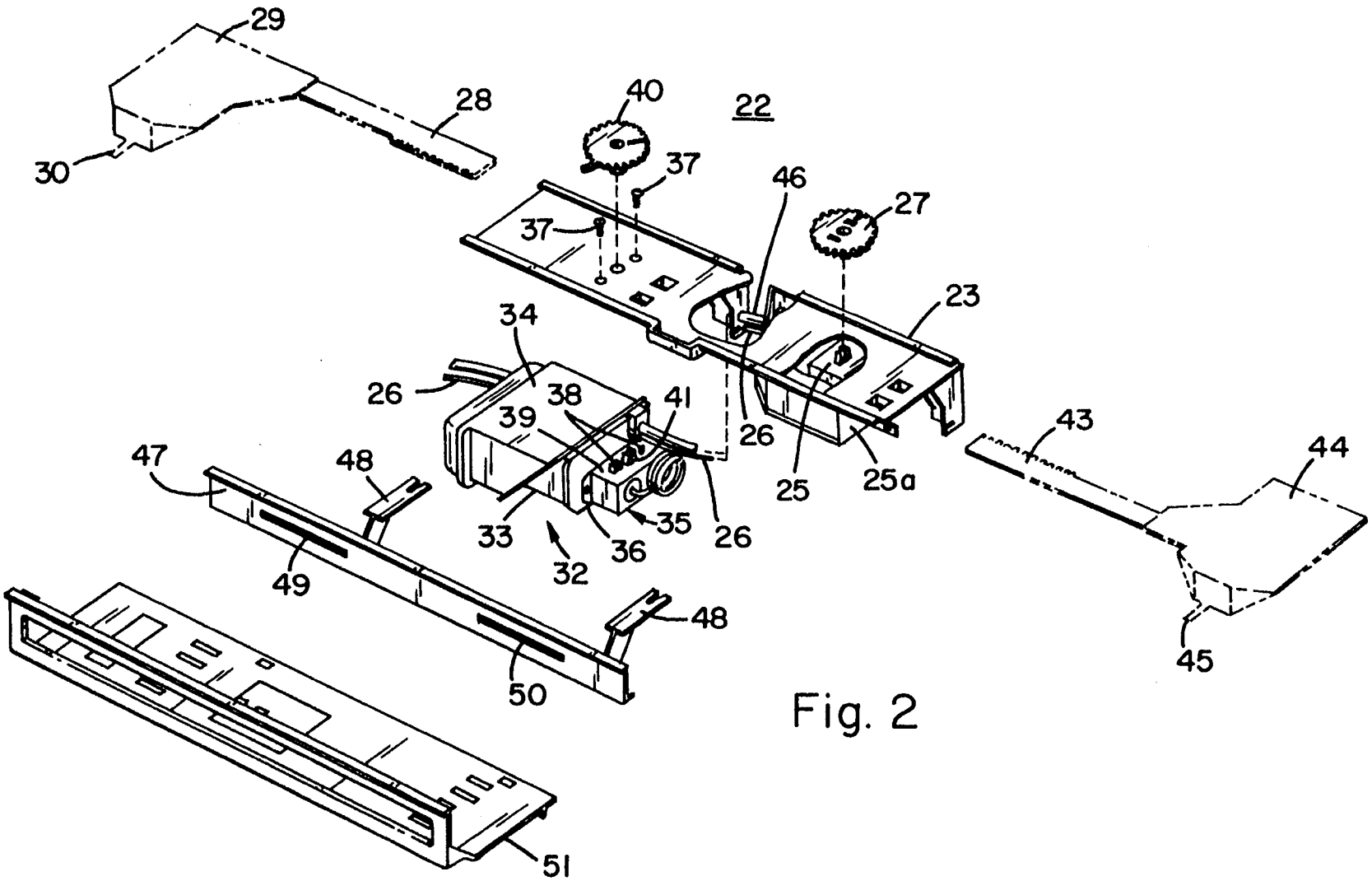
FIG. 2 is an exploded view of the control arrangement for the refrigerator of FIG. 1, with the view being somewhat simplified and with some parts omitted for the sake of simplicity.
Figure 3:
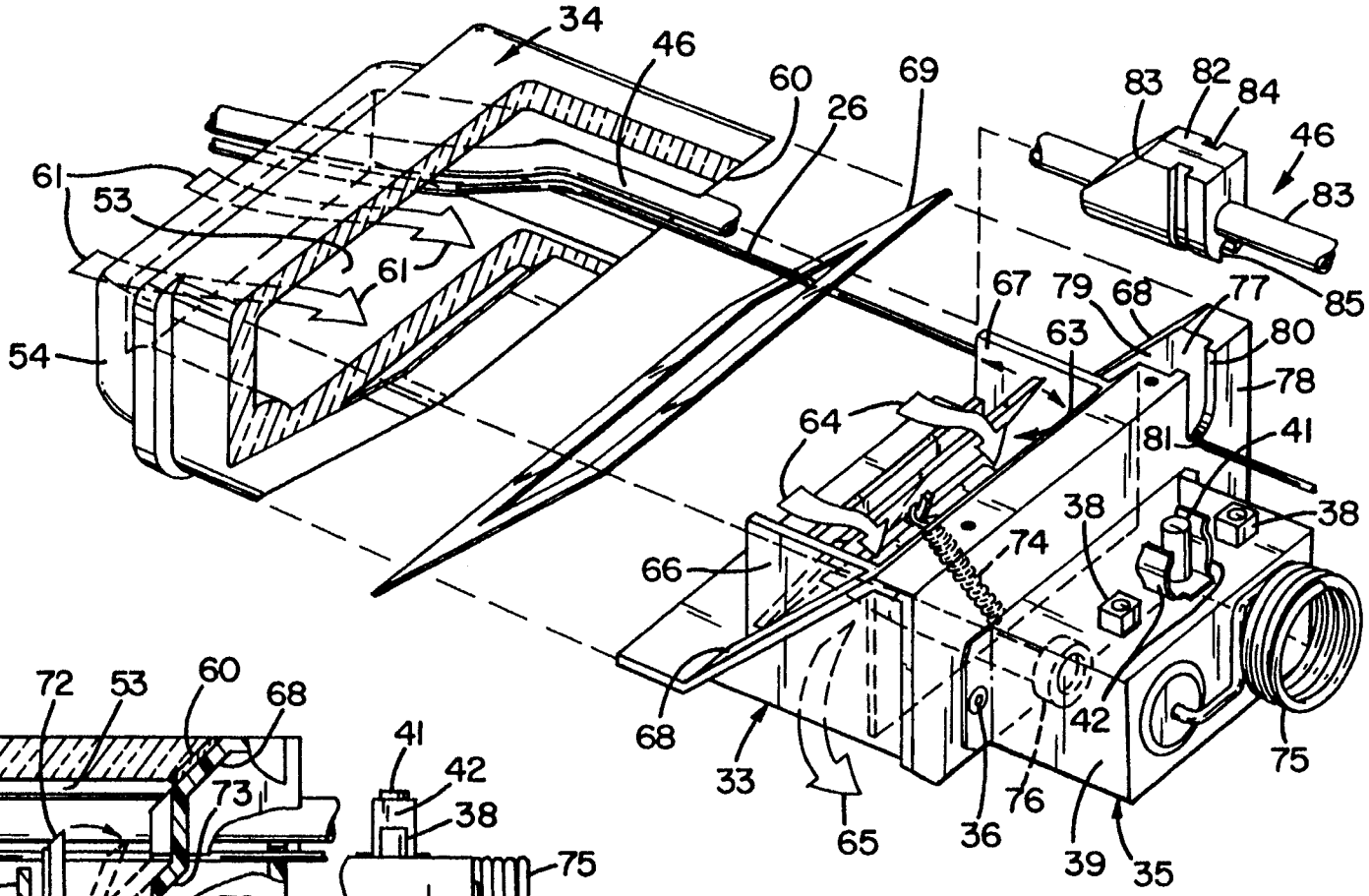
FIG. 3 is an exploded perspective view of the air flow control mechanism for the refrigerator of FIG. 1, with some parts broken away for purposes of illustration.
Figure 4:
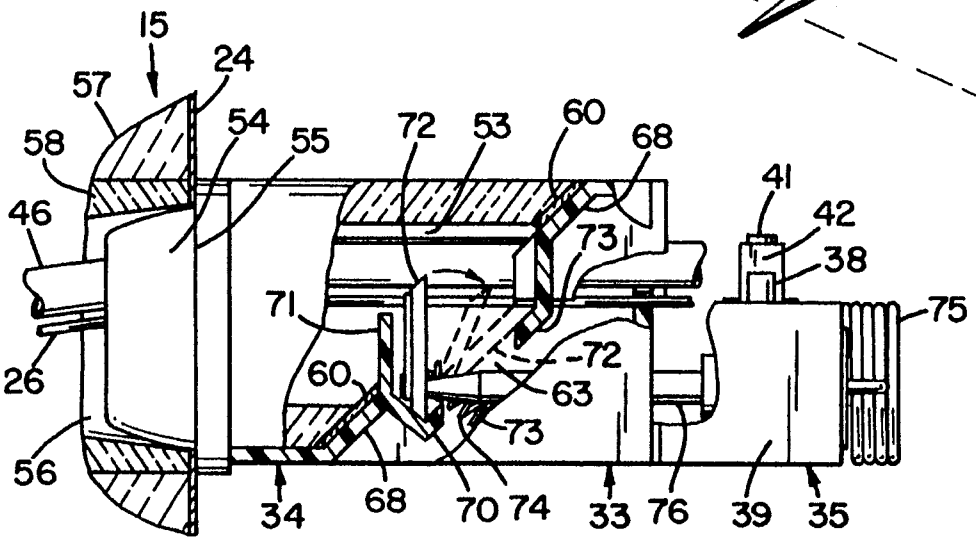
FIG. 4 is a side elevation view of the mechanism of FIG. 3, partly in section for purposes of illustration.

A control assembly, generally indicated at 22 is provided near the top of fresh food compartment 14. Referring now more particularly to FIG. 2, the assembly 22 includes a main support 23, that is mounted to the liner 24 forming the fresh food compartment 14. The base 23 supports various operational components and controls for both the fresh food and freezer compartments. A freezer thermostat 25 is mounted in a protective cover or housing 25*a* and its capillary tube 26 extends across the control 22 and into the freezer compartment, as is shown in FIGS. 2–4. The setting of the thermostat 25 is controlled by movement of a pinion gear 27 mounted on top of the main support 23. The pinion gear 27 is rotated by an elongated rack gear 28, which is formed integrally with a base 29. The base 29 is mounted for sliding movement on the main support 23 and includes a tab 30 extending forward for the user to grasp in moving the rack gear 28.

An air flow control mechanism 32 is provided to control the amount of cold air which flows from the freezer compartment into the fresh food compartment so as to control the temperature in the fresh food compartment. As will be described in greater detail hereafter, the control mechanism includes a housing 33, air flow tube 34 and a fresh food thermostat 35. The housing 33 and thermostat 35 are connected by screws 36 and the control mechanism 32 is connected to the main support 23 by screws 37 that extend through the support 23 and are threaded into bosses 38 in the housing 39 of thermostat 35. The setting of fresh food thermostat 35 is controlled by a pinion gear 40 which fits over the operating shaft 41 of the thermostat and is secured by spring 42 (see FIG. 3). The pinion gear 40 is rotated by an elongated rack gear 43, which is formed integrally with a base 44. The base 44 is mounted for sliding movement on the main support 23 and includes a tab 45 extending forward for the user to grasp in moving the rack gear 43.

A flexible electrical conductor 46 extends across the main support 23 and into the freezer compartment, as shown by FIGS. 2–4. A lamp, not shown, may be mounted between the housing 25*a* and the thermostat 35. A bezel 47 is mounted to the front of the main support 23 by split fingers 48 which fit around tabs, not shown, on the support. The bezel includes a pair of spaced apart openings or slits 49,50 through which the tabs 30,45 extend for manipulation by an user. A bottom cover 51 is mounted on the main support and encloses the various operating components. Additional details of the assembly and operation of various of the components of the control assembly 22 may be had by reference to co-pending applications 9D-HR-18479 and 9D-HR-18480, which are assigned to General Electric Company, assignee of the present invention and are hereby incorporated herein by reference.

Referring more particularly now to FIGS. 3 and 4, the air flow tube 34 preferably is a hollow sleeve or elongated peripheral wall having a generally rectangular cross section. Preferably the tube is made of a suitable foam material such as polystyrene for example. The tube defines a central, elongated air flow passage 53 which is generally rectangular in cross section and extends throughout the length of the tube 34. The left end portion of the tube 34, as seen in FIGS. 3 and 4, is formed as a nose 54 and a shoulder or offset rim 55 is spaced back slightly form the distal end of the nose 54. As seen in FIG. 4, when the tube 34 is mounted in the refrigerator 12, the nose is seated in an opening 56 in the mullion 15 with the shoulder against the fresh food liner 24 to prevent air from leaking around the outside of the tube 34. The mullion conveniently may be of a well known construction in which a layer 57 of polyurethane is foamed in place between the fresh food liner 24 and a similar liner of the freezer, not shown. If desired a sleeve 58 of denser foam or other suitable material may be used to line the periphery of the mullion opening 56.

The other end of the tube 34 is beveled to provide a planar end surface 60 which is in the shape of an open rectangle and is angled relative to both the axis of the tube 34 and the mullion 15. More specifically, in the exemplification, the tube 34 is substantially perpendicular to the mullion, with the mullion extending vertically and the tube projecting generally horizontally from the mullion into the fresh food compartment. The end surface 60 is angled at about forty-five degrees from the vertical. Air from the freezer is free to flow axially through the air flow passage 53 from one end of the tube 34 to the other as indicated by arrows 61.

The housing 33 preferably is formed as a molded body of a suitable plastic material, such as polystrene for example. The housing 33 defines an air flow passage 63 which mates with tube air flow passage 53 at one end, as shown by air flow direction arrows 64, and opens downwardly its other end, as shown by air flow arrow 65. With this construction, the air tube passage 53 and the housing passage 63 form a continuous passageway for the air and cold air from the freezer will exit downwardly into the fresh food compartment from the control assembly 22. The sides of the passage 63 is formed by lateral walls or dams 66 and 67 which are received in the tube air passage 53 and rest against the sides of the tube 34 when the tube and housing are assembled. A planar flange 68 extends outwardly around the inner end of the passage 63. The flange is complementary to the tube end surface 60. That is it is in the form of an open rectangle substantially the same size as end surface 60 and is tilted at the same angle as the end surface 60. The housing 33 and tube 34 are joined by bringing flange 68 and end surface 60 into juxtaposition with a gasket 69 sandwiched between them. The gasket 69 preferably is generally planar and is in the form of an open rectangle of the same size and shape as the end surface 60 and flange 68. Preferably gasket 69 is made of a suitable foam or other acceptable material with an adhesive on both of its sealing surfaces. In this manner the gasket is joined to both the tube 34 and the housing 33 to provide an unitary structure and prevent air leakage between the tube and housing. Since the sealing surfaces are flat planes and there are no bends or offsets in the seal, the air tight integrity of the joint is significantly enhanced.

Referring particularly to FIG. 4, a trough shaped wall 70 extends across the passage 63 between side walls 66, 67 and a vertical backing wall 71 projects upward from the edge of trough wall 70 closest to the tube 34. A baffle 72 is pivotally mounted in the bight 73 of trough wall 70 and is movable between a first position against the backing wall, generally as shown in solid line in FIG. 4, and a second position against a cross wall 73, generally as shown in dotted line in FIG. 4. In its position against backing wall 71, the baffle is substantially clear of the housing air passage 63 and maximum air flow between the freezer and fresh food compartments is enabled. In its position against the cross wall 73, the baffle substantially closes off the housing air passage 63 and air flow from the freezer to the fresh food compartment is substantially prevented. The amount of air flow varies as the baffle is moved between its extreme positions.

A spring 74 is connected between the baffle 72 and the housing 33 and biases the baffle to its position blocking air flow. The fresh food thermostat 35 includes a capillary tube 75 which senses the temperature of the air in the fresh food compartment and a bellows , not shown, which expands and contracts in response to the fluid in the capillary tube so that its length varies with the temperature in the fresh food compartment. In the illustrative embodiment, the thermostat is a Model RD18-2001 sold by Robert Shaw. A plunger or follower 76 connects the thermostat bellows and the baffle so that the thermostat exerts a force on the baffle in opposition to the bias of spring 74. More particularly, when the temperature in the fresh food compartment 14 is at or below the temperature set by the user with knob 45 (see FIG. 1) the follower has withdrawn enough that the spring moves the baffle into engagement with cross wall 73 and little if any cold air can flow from the freezer to the fresh food compartment. As the fresh food compartment temperature rises the bellows in thermostat 35 expands and the follower 76 rotates the baffle against the bias of spring 74 toward its solid line position, as seen in FIG. 4, so that more cold air can flow from the freezer to the fresh food compartment.

As previously stated, the electric conductor 46 and the capillary tube 26 for the freezer thermostat 25 extend across the control assembly 22 and through the mullion 15 into the freezer. In order to reduce the number of openings in the mullion the conductor and capillary tube are routed through the passageway formed by passage 53 in the air flow tube 34 and passage 63 in the housing 33. To that end the housing is formed with a recess 77 extending from the flange 68 to a rear wall 78. The flange 68 is interrupted in the area 79 in alignment with the recess 77 and the rear wall 78 has a lip portion 80 which extends around the edge of the recess 77. A small dimple 81 is formed in the bottom of the lip 80 and is sized to snugly receive the capillary tube 26.

The conductor 46 includes wear resistant outer cover of a molded vinyl material. A plug 82 is integrally molded with the cover and is sized and shaped to fit snugly into the recess 77. The plug 82 includes an inclined planar portion or face 83 which fills the interrupted area 79 of the flange 68. The plug also include a peripheral recess 84 positioned and shaped to closely receive of snugly fit about the lip portion 80 of housing rear wall 78. A small dimple 85 is formed in the bottom portion of the plug 82, intersecting the recess 84, and closely receives or snugly fits about the capillary tube 26.

In assembly, capillary tube 26 and conductor 46 are fed through passage 53 and the capillary is inserted into dimple 81 in lip 80. Then the plug 82 is fully seated into recess 77 with lip 80 of wall 78 closely received in recess 84 of plug 82, planar face 83 of plug 82 filling the interruption 79 in flange 68 and plug dimple 85 closely surrounding capillary tube 26. Thereafter the housing 33 and air flow tube 34 are brought into juxtaposition and gasket 69 is attached to both the end surface 60 of tube 34 and flange 68 of housing 33, including the planar face 83 of plug 82 filling the interruption in the flange. With this arrangement the passage of the conductor 46 and capillary tube 26 between the fresh food and freezer compartments does not result in any deleterious leakage of air between the compartments.

While a specific embodiment of the the present invention has been illustrated and described herein, it is realized that modifications and changes will occur to those skilled in the art to which it pertains. It is intended therefore that the appended claims cover all such modifications and changes as fall within the true spirit and scope of the invention.

What is claimed is:

1. In a refrigerator with a freezer compartment and a fresh food compartment separated by a mullion with an opening therethrough, a mechanism for controlling the flow of air between the compartments, including:

an air flow tube including an elongated peripheral wall having a longitudinal axis and defining a central air passage therethrough, said wall including one end received in the opening in the mullion and another end positioned in one of the compartments, said other end of said peripheral wall being formed with a planar end surface angled with respect to the longitudinal axis of said tube;

an air flow control including a housing defining an air flow passage therethrough and having a planar flange surrounding one end of said housing passage; said flange being a shaped and angled complimentarily to said planar end surface of said air flow tube, said air flow tube and said air control housing being connected with said tube end surface and said housing flange juxtaposed so that said air flow tube passage and said housing passage form a continuous passageway between the refrigerator compartments; and a planar gasket, having a shape complimentary to said air flow tube end surface and to said housing flange, received between said end surface and said flange, whereby said junction between said air flow tube end surface and said housing flange is provided with a simple and effective seal.

2. An air flow control mechanism as set forth in claim 1, wherein: said gasket is a foam member joined to each of said end surface and said flange with adhesive.

3. An air flow control mechanism as set forth in claim 1, further including:

a baffle mounted in said housing, said baffle having a first position limiting air flow through said housing passage and being movable away from its first position to permit greater air flow through said housing passage;

means biasing said baffle for movement in one direction relative to its first position;

thermostatic means positioned to sense the temperature of air in the one of the compartments and connection means interconnecting said thermostatic means and said baffle and movable by said thermostatic means in opposition to said biasing means;

whereby the position of said baffle is adjusted in response to variations of the temperature of the air in the one compartment.

4. An air flow control mechanism as set forth in claim 1, wherein: said housing includes projecting flanges received in said tube passage adjacent said tube peripheral wall.

5. An air flow mechanism as set forth in claim 1, wherein:

a flexible electrical conductor extends between the refrigerator compartments through said passageway;

said housing includes a wall spaced from said flange and including a portion defining a recess, said flange being interrupted in an area aligned with said recess;

a plug encloses said conduit and includes a peripheral recess closely receiving said portion of said housing wall defining said recess, said plug also includes an inclined planar portion which fills said interruption in said housing flange and is co-planar therewith;

whereby passage of said conduit through said passageway does not cause deleterious air leakage between the refrigerator compartments.

6. An air flow control mechanism as set forth in claim 5, wherein:

a thermostatic capillary tube extends between the refrigerator compartments through said passageway;

said portion of said housing wall defining said recess includes a dimple shaped to closely receive said capillary tube; and said conduit plug includes a dimple shaped to fit around said capillary tube, so that passage of said capillary tube through said passageway does not cause deleterious air leakage between the refrigerator compartments.

7. An air flow control mechanism as set forth in claim 5, wherein: said electric conductor includes an outer protective cover of a plastic material and said plug is integrally molded with said cover.

8. A refrigerator including:

a freezer compartment and a fresh food compartment arranged in side-by-side relationship and separated by a mullion, said mullion including an opening therethrough for passage of cold air from said freezer to said fresh food compartment;

a support mounted in said fresh food compartment adjacent said mullion and close to the opening therethrough, said support projecting generally perpendicular to said mullion;

an elongated air flow tube including a peripheral wall having a longitudinal axis and defining a generally rectangular cross-section air flow passage therethrough with; one end of said tube being received in the said mullion opening and said tube including a rim seated against said mullion around the opening in said mullion; the other end of said tube being positioned in said fresh food compartment and the other end portion of said tube peripheral wall being formed with a planar end surface angled with respect to the longitudinal axis of said tube;

an air flow control including a housing mounted to said support and defining a generally rectangular cross-section air flow passage therethrough, said housing including a flange surrounding said housing passage, said flange being angled and shaped complimentarily to said end surface of said air flow tube; said air flow tube and said housing being connected with said tube end surface and said housing flange juxtaposed so that said air flow passage and said housing passage form a continuous air flow passageway between said freezer and fresh food compartments; and a gasket, complimentary in shape to said air flow tube end surface and to said housing flange, received between said end surface and said flange and joined to each with adhesive.

9. A refrigerator as set forth in claim 8, further including:

a baffle mounted in said housing, said baffle having a first position limiting air flow through said housing passage and being movable away from its first position to permit greater air flow through said housing passage;

means biasing said baffle for movement in one direction relative to its first position;

thermostatic means connected to said housing and positioned to sense the temperature of air in said fresh food compartment and connection means interconnecting said thermostatic means and said baffle and movable by said thermostatic means in opposition to said biasing means;

whereby the position of said baffle is adjusted in response to variations of the temperature of the air in said fresh food compartment.

10. A refrigerator as set forth in claim 8, wherein: said housing includes projecting flanges received in said tube passage adjacent said tube peripheral wall.

11. A refrigerator as set forth in claim 8, wherein:

a flexible electrical conductor extends between said freezer and said fresh food compartments through said passageway;

said housing includes a wall spaced from said flange and including a portion defining a recess, said flange being interrupted in an area aligned with said recess;

a plug encloses said conduit and includes a peripheral recess closely receiving said portion of said housing wall defining said recess, said plug also includes an inclined planar portion which fills said interruption in said housing flange and is co-planar therewith;

whereby passage of said conduit through said passageway does not cause deleterious air leakage between said freezer and fresh food compartments.

12. A refrigerator as set forth in claim 11, wherein:

a thermostatic capillary tube extends between said freezer and fresh food compartments through said passageway;

said portion of said housing wall defining said recess includes a dimple shaped to closely receive said capillary tube; and said conduit plug includes a dimple shaped to fit around said capillary tube, so that passage of said capillary tube through said passageway does not cause deleterious air leakage between said freezer and fresh food compartments,

13. A refrigerator as set forth in claim 11, wherein: said electric conductor includes an outer protective cover of a plastic material and said plug is integrally molded with said cover.

* * * * *